US008740124B2

(12) United States Patent
Cheng

(10) Patent No.: US 8,740,124 B2
(45) Date of Patent: Jun. 3, 2014

(54) EARPHONE CABLE WINDER

(75) Inventor: Quan-Chang Cheng, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 214 days.

(21) Appl. No.: 13/283,568

(22) Filed: Oct. 27, 2011

(65) Prior Publication Data

US 2013/0001346 A1 Jan. 3, 2013

(30) Foreign Application Priority Data

Jun. 28, 2011 (CN) ..... 2011 1 0176755

(51) Int. Cl.
*B65H 75/48* (2006.01)

(52) U.S. Cl.
USPC ..... 242/378; 242/378.1; 242/378.4

(58) Field of Classification Search
USPC ..... 242/378, 378.1–378.4
See application file for complete search history.

(56) References Cited

U.S. PATENT DOCUMENTS

| | | | | |
|---|---|---|---|---|
| 4,417,703 | A * | 11/1983 | Weinhold | 242/378.3 |
| 4,901,938 | A * | 2/1990 | Cantley et al. | 242/378.1 |
| 6,250,578 | B1 * | 6/2001 | Manda | 242/378.1 |
| 6,484,958 | B1 * | 11/2002 | Xue et al. | 242/378.1 |
| 6,616,080 | B1 * | 9/2003 | Edwards et al. | 242/378.1 |
| 7,093,783 | B2 * | 8/2006 | Warren et al. | 242/385.4 |

* cited by examiner

*Primary Examiner* — Sang Kim
(74) *Attorney, Agent, or Firm* — Novak Druce Connolly Bove + Quigg LLP

(57) ABSTRACT

An earphone cable winder for winding at least one cable of an earphone includes a first housing, a second housing coupled to the housing, at least one rotatable assembly rotatably arranged within a space defined by the first housing and the second housing, and a switch assembly connected to one of the first housing and the second housing. The first housing defines at least one first channel. The second housing defines at least one second slot communicating with the at least one first channel to store the at least one cable of the earphone. The rotatable assembly is configured to wind at least one cable of the earphone therearound. The latching arm is slidable between a first position where the at least one latching arm restricts the at least one cable from moving, and a second position where the at least one latching arm releases the at least one cable.

11 Claims, 5 Drawing Sheets

EARPHONE CABLE WINDER

BACKGROUND

1. Technical Field

The present disclosure relates to an earphone cable winder capable of automatically winding the cable of earphones.

2. Description of Related Art

Often times, the cable of earphones become tangled, thereby causing inconvenience. Conventional earphone cable winders always include an arm for users to manually wind the cable around. Thus, a new type of earphone cable winder capable of automatically winding the cable is still desired.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure are now described, with reference to the accompanying drawings.

Figure 1:
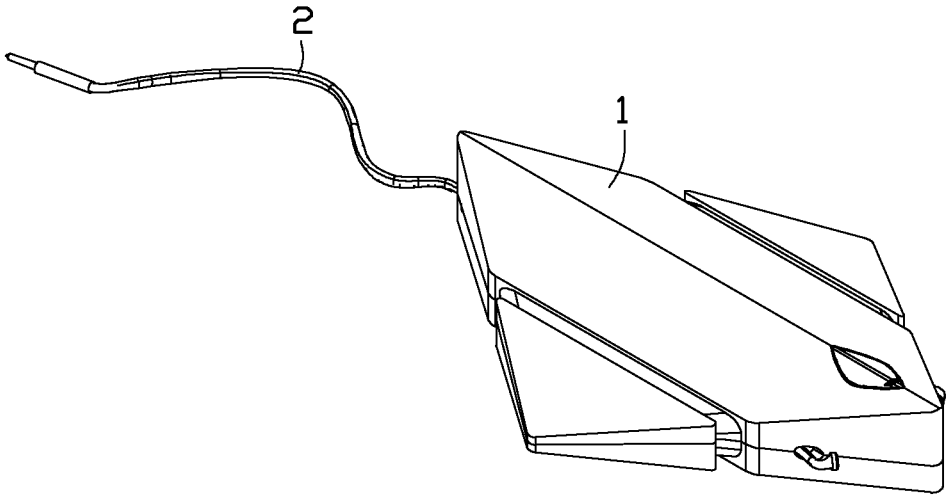
FIG. 1 is an isometric, assembled view of an earphone cable winder and an earphone according to an exemplary embodiment.
Figure 2:
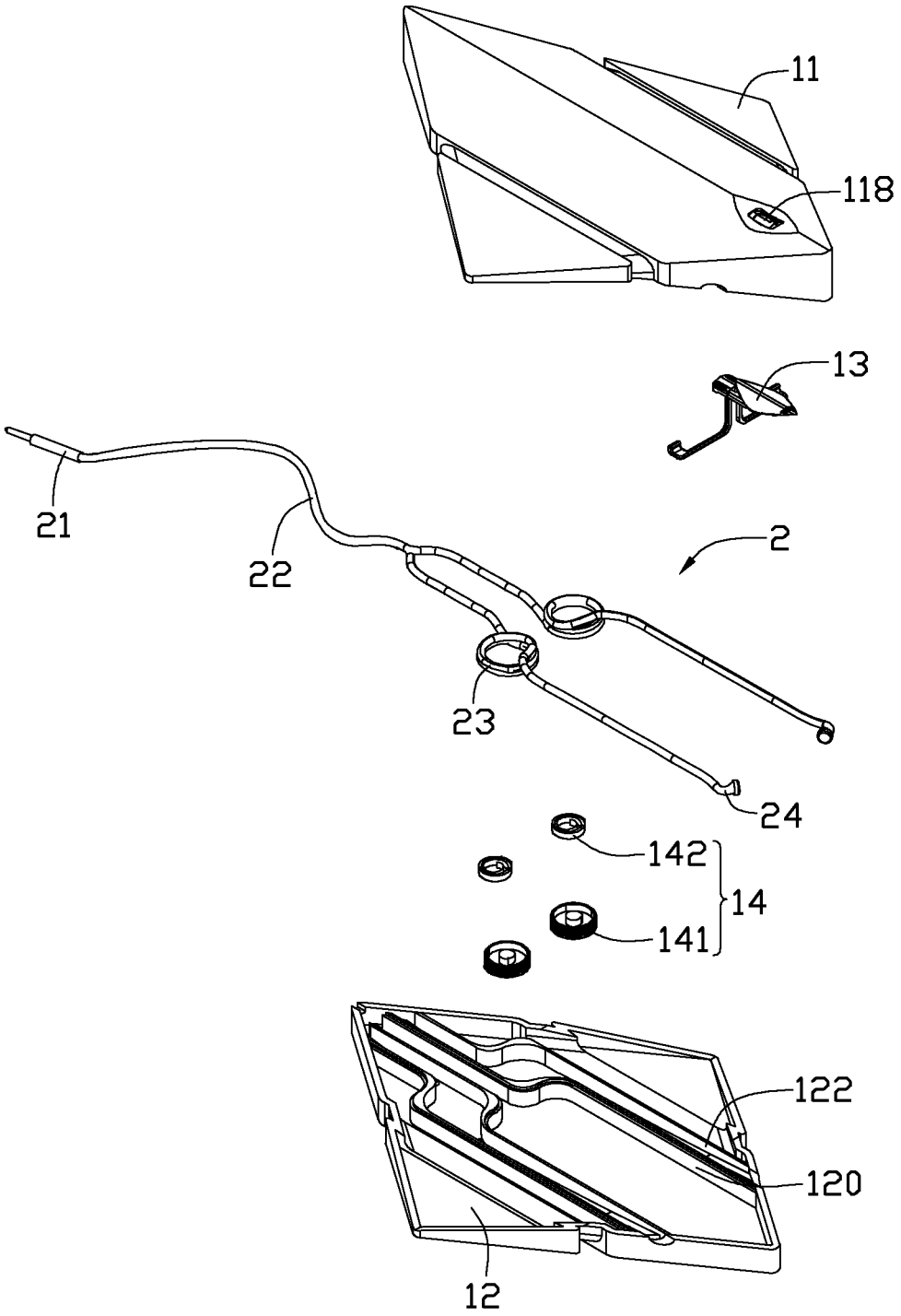
FIG. 2 is an isometric, exploded view of the earphone cable winder of FIG. 1.

Referring to FIGS. 1-2, an earphone cable winder 1 for an earphone 2 according to an exemplary embodiment is illustrated. The earphone 2 includes a plug 21, a first cable 22, two second cables 23 branched from the first cable 22, two earbuds 24 respectively connected to the ends of the two second cables 23. The diameter of the earbud 24 is greater than that of the second cables 23. The earphone cable winder 1 is configured for winding the second cable 23 and thus preventing the first cable 22 and the second cables 23 from getting tangled.

Figure 3:
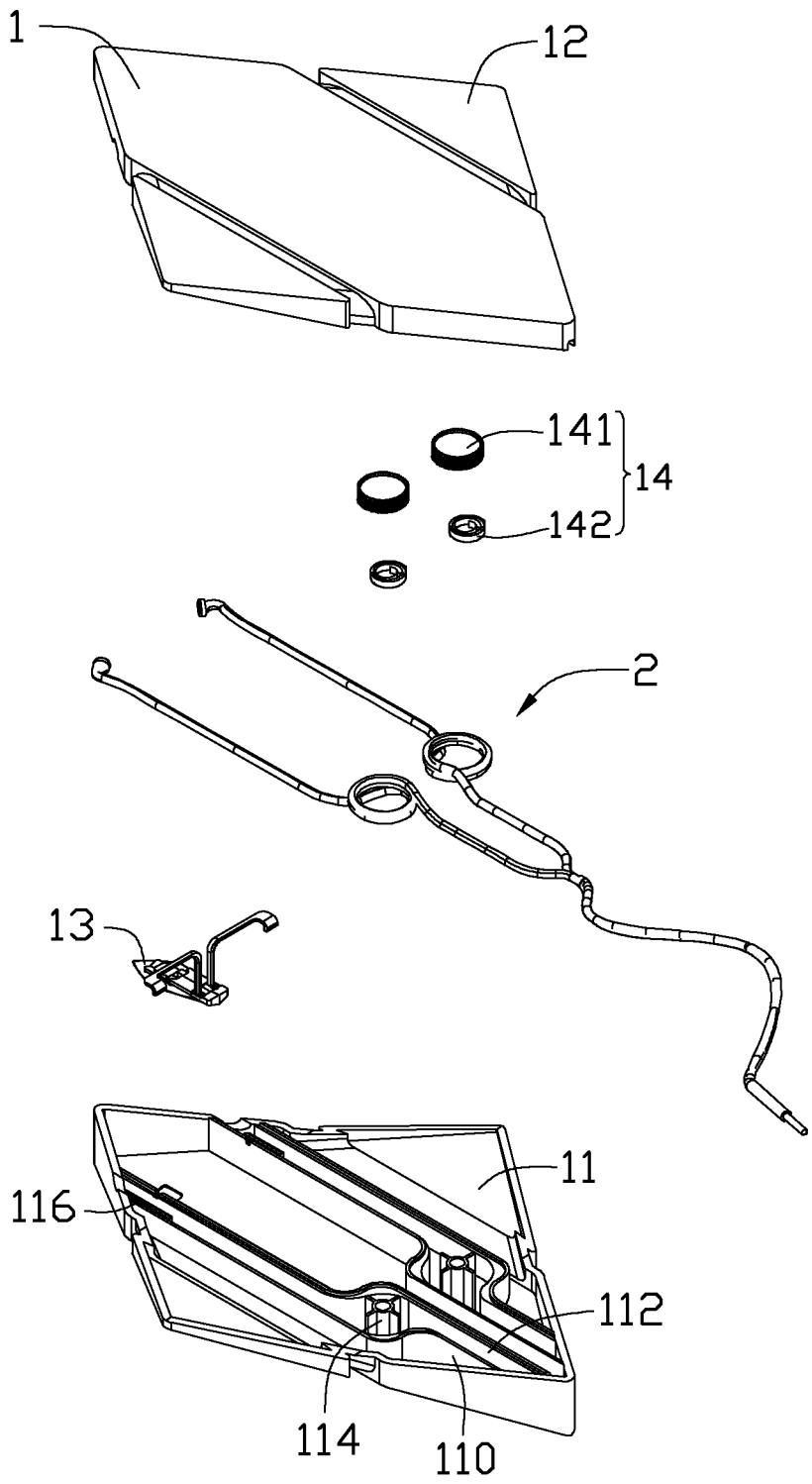
FIG. 3 is similar to FIG. 2, but viewed from a reverse direction.

Referring to FIG. 3, the earphone cable winder 1 includes a first housing 11, a second housing 12 coupled to the first housing 11, a switch assembly 13 mounted on the first housing 11, and two rotatable assemblies 14 for winding the second cables 23.

The first housing 11 includes two first guide members 110, each defines a first channel 112. The first housing 11 further includes a positioning post 114 and a protrusion 116 protruding from a bottom of each first channel 112. The first housing 11 further defines a mounting hole 118 (FIG. 1) running therethrough for mounting the switch assembly 13.

The second housing 12 defines two second guide members 120, each of which defines a second channel 122 matching and communicating with one first channel 112.

Figure 4:
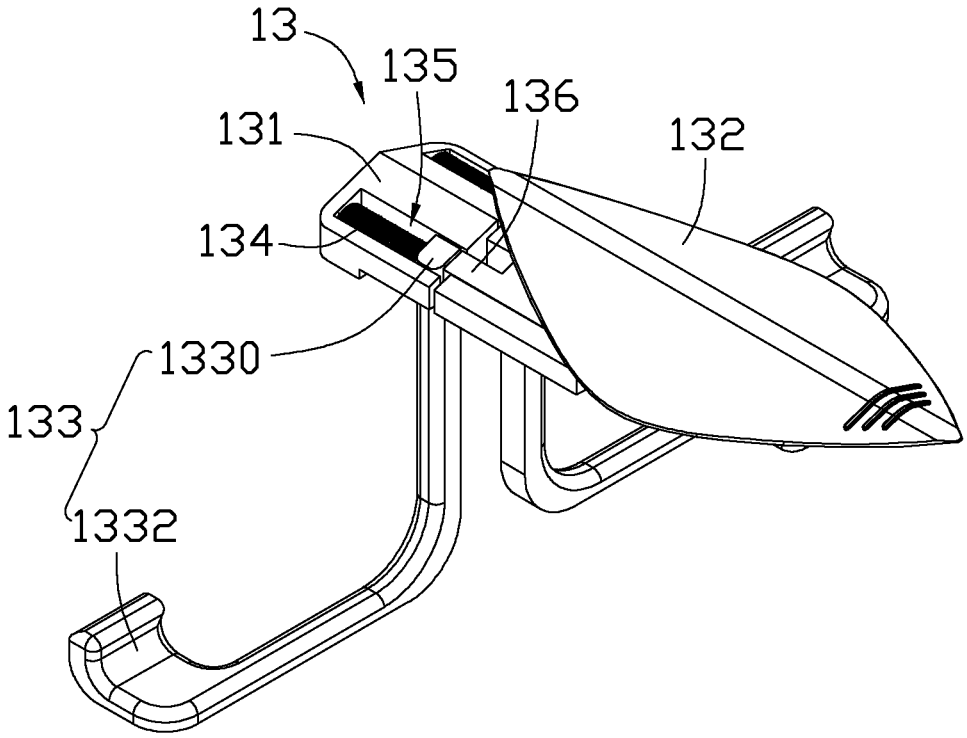
FIG. 4 is an isometric view of a switch assembly of the earphone cable winder of FIG. 1.

Referring to FIG. 4, the switch assembly 13 includes a main body 131 securely retained within the mounting hole 118, a slider 132, two latching arms 133, and two resilient members 134. The main body 131 defines two grooves 135 extending substantially parallelly to each other. The slider 132 includes two rods 136. Each latching arm 133 is L-shaped. The latching arm 133 includes a first end 1330 fixed to the rod 136 and an opposite second end 1332 retained within the first channel 112. The slider 132 and the latching arm 133 are movable relative to the main body 131 between a first position and a second position. The resilient member 134 is retained within in the groove 135 and resisting the first end 1330. Therefore, the resilient member 134 provides a spring force to the latching arm 133, which prevents the slider 132 and the latching arm 133 from moving to the second position.

Each rotatable assembly 14 includes a rotator 141 rotatably connected to the positioning post 114 and a torsion spring 142 with two opposite ends respectively connected to the rotator 141 and the positioning post 114. Thus, the torsion spring 142 can apply a spring force to the rotator 141.

Figure 5:
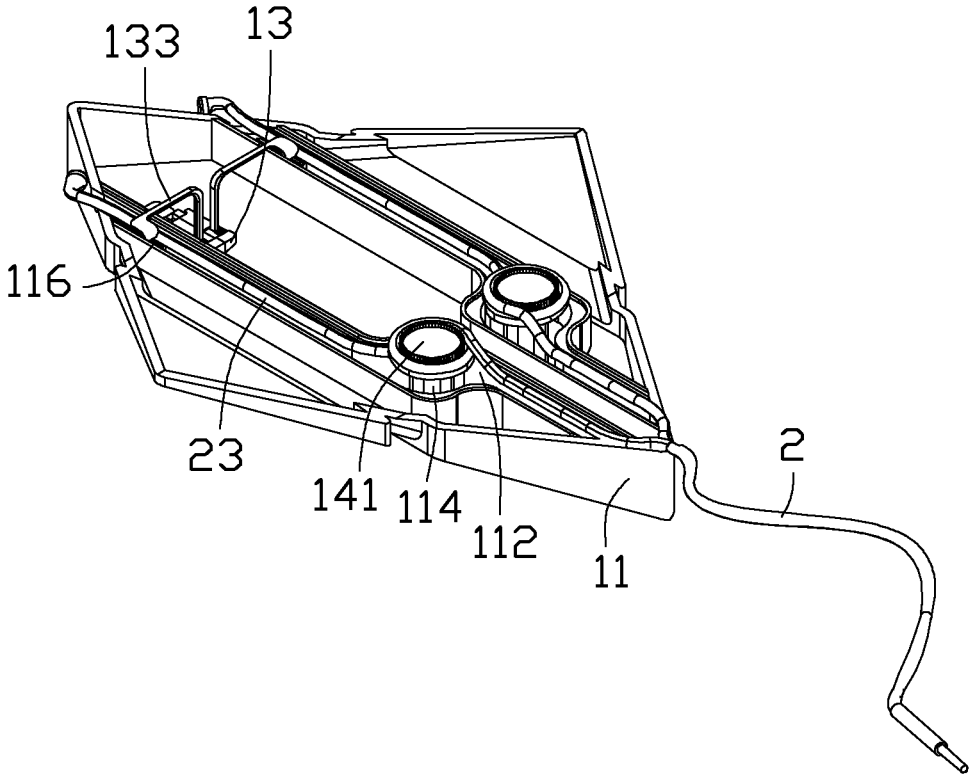
FIG. 5 is a partial, assembled view of the earphone cable winder and the earphone of FIG. 1.

Referring to FIG. 5, the second cables 23 of the earphone 2 are retained within the first channels 12 and a portion of each cable 23 is wound around one rotator 141. Each second cable 23 passes through the gap between the second end 1332 of one latching arm 133 and one protrusion 116. The earbuds 24 are external to the earphone cable winder 11.

When the slider 132 and the latching arms 133 are in the first position, the second ends 1332 of the latching arms 133 firmly press the second cables 23 against the protrusions 116, thereby limiting the movement of the second cables 23. When the slider 133 and the latching arms 133 are slid to the second position by a user, the second ends 1332 of the latching arms 133 are away from the protrusions 116, thereby freeing the second cables 23 from limitation. The second cables 23 can thus be automatically wound around the rotators 141 as driven by the torsion springs 142. Therefore, the earphone cable winder 1 can prevent the first cable 22 and the second cables 23 from getting tangled. Also, the earbuds 24 can be manually pulled out of the earphone cable winder 1 when the slider 133 and the latching arms 133 are slid to the second position.

While various embodiments have been described and illustrated, the disclosure is not to be constructed as being limited thereto. Various modifications can be made to the embodiments by those skilled in the art without departing from the true spirit and scope of the disclosure as defined by the appended claims.

What is claimed is:

1. An earphone cable winder for winding at least one cable of an earphone, the earphone cable winder comprising:

a first housing defining at least one first channel corresponding to the at least one cable;

a second housing coupled to the first housing and defining at least one second channel corresponding and communicating with the at least one first channel to store the at least one cable of the earphone;

at least one rotatable assembly rotatably arranged within a space defined by the first housing and the second housing and configured to wind the at least one cable of the earphone therearound; and a switch assembly connected to one of the first housing and the second housing and comprising at least one latching arm within the space, wherein the at least one latching arm is slidable between a first position where the at least one latching arm restricts the at least one cable from moving, and a second position where the at least one latching arm releases the at least one cable;

wherein the first housing comprises at least one first guide defining the at least one first channel; and wherein the first housing defines a mounting hole and comprises a protrusion, and the switch assembly comprises a main body securely retained within the mounting hole, the at least one latching arm is slidably connected to the main body between the first position and the second position, and the at least one latching arm firmly presses the at least one cable of the earphone against the protrusion while being positioned at the first position.

2. The earphone cable winder as described in claim 1, wherein the second housing comprises at least one second guide member defining the at least one second channel communicating with the at least one first channel.

3. The earphone cable winder as described in claim 1, wherein each of the at least one rotatable assembly comprises:

a rotator rotatably connected to a bottom of a corresponding one of the at least one first channel, wherein a corresponding one of the at least one cable of the earphone is wound around the rotator; and a torsion spring with two opposite ends respectively connected to the first housing and the rotator for rotating the rotator, to apply a spring force to the rotator for winding the at least one cable around the rotator.

4. The earphone cable winder as described in claim 3, wherein the first housing comprises at least one positioning post, each of the at least one positioning post protrudes from a bottom of a corresponding one of the at least one first channel, and a corresponding one of the at least one rotator is respectively rotatably connected to the positioning post.

5. The earphone cable winder as described in claim 1, wherein the first housing comprises at least one protrusion, each of the at least one protrusion protrudes from a bottom of a corresponding one of the at least one first channel, and the at least one latching arm each comprises a second end retained within a corresponding one of the at least one first channel and firmly pressing a corresponding one of the at least one cable against the protrusion.

6. The earphone cable winder as described in claim 5, wherein the switch assembly further comprises a slider slidably connected to the main body for pushing the at least one latching arm, the slider comprises at least one rod, and each of the at least one latching arm further comprises a first end fixed to a corresponding one rod of the at least one rod.

7. The earphone cable winder as described in claim 6, wherein the main body defines at least one groove, the switch assembly comprises at least one resilient member, and each of the at least one resilient member is retained within in a corresponding one of the at least one groove and resisting the first end of a corresponding first end of the at least one latching arm to provide a spring force which prevents the latching arm from sliding to the second position.

8. An earphone cable winder for winding at least one cable of an earphone, the earphone cable winder comprising:

a first housing defining at least one first channel corresponding to the at least one cable;

a second housing coupled to the first housing and defining at least one second channel corresponding and communicating with the at least one first channel to store the at least one cable of the earphone;

at least one rotatable assembly rotatably arranged within a space defined by the first housing and the second housing and configured to wind the at least one cable of the earphone therearound; and a switch assembly connected to one of the first housing and the second housing and comprising at least one latching arm within the space, wherein the at least one latching arm is slidable between a first position where the at least one latching arm presses the at least one cable to one of the first housing and the second housing for restricting the at least one cable from moving, and a second position where the at least one latching arm releases the at least one cable;

wherein the first housing defines a mounting hole and comprises a protrusion, and the switch assembly comprises a main body securely retained within the mounting hole, wherein the at least one latching arm is slidably connected to the main body between the first position and the second position, and the at least one latching arm firmly presses the at least one cable of the earphone to the protrusion while being positioned at the first position.

9. The earphone cable winder as described in claim 8, wherein the first housing comprises at least one protrusion, each of the at least one protrusion protrudes from a bottom of a corresponding one of the at least one first channel, and the at least one latching arm each comprises a second end retained within a corresponding one of the at least one first channel and firmly pressing a corresponding one of the at least one cable against the protrusion.

10. The earphone cable winder as described in claim 9, wherein the switch assembly further comprises a slider slidably connected to the main body for pushing the at least one latching arm, the slider comprises at least one rod, and each of the at least one latching arm further comprises a first end fixed to a corresponding one rod of the at least one rod.

11. The earphone cable winder as described in claim 10, wherein the main body defines at least one groove, the switch assembly comprises at least one resilient member, and each of the at least one resilient member is retained within in a corresponding one of the at least one groove and resisting the first end of a corresponding first end of the at least one latching arm to provide a spring force which prevents the latching arm from sliding to the second position.

* * * * *